US007083245B2

(12) United States Patent
Yamamoto

(10) Patent No.: US 7,083,245 B2
(45) Date of Patent: Aug. 1, 2006

(54) RECORDING APPARATUS

(75) Inventor: Kosuke Yamamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 379 days.

(21) Appl. No.: 10/406,456

(22) Filed: Apr. 4, 2003

(65) Prior Publication Data

US 2003/0193673 A1 Oct. 16, 2003

(30) Foreign Application Priority Data

Apr. 15, 2002 (JP) ..... 2002-112074

(51) Int. Cl.
*B41J 25/308* (2006.01)

(52) U.S. Cl. ..... 347/8; 400/55; 400/56; 400/57; 400/58; 400/59; 400/60

(58) Field of Classification Search ..... 347/8; 400/55–60

See application file for complete search history.

(56) References Cited

U.S. PATENT DOCUMENTS 5,757,393 A * 5/1998 Suzuki ..... 347/16
6,151,040 A 11/2000 Takada et al.
6,629,787 B1 * 10/2003 Lee et al. ..... 400/59

FOREIGN PATENT DOCUMENTS

JP 7-181756 7/1995
JP 10-198174 7/1998

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

A reliable detection of optically detecting the type of recording media is achieved. A part of a support member for supporting an optical sensor is pushed against the surface of a sheet by a spring so as to maintain the gap between the sensor and the sheet surface. With this arrangement, a recording apparatus which is free from wrong detection is achieved regardless of a gap-varying factor, that is, the remaining amount of sheets. Also, by arranging a part of a light-shielding hood so as to abut against the sheet, wrong detection due to disturbance light can be prevented.

11 Claims, 9 Drawing Sheets

RECORDING APPARATUS

BACKGROUND OF THE INVENTION

1. Field of the Invention

The present invention relates to a recording apparatus which detects the type of recording media.

2. Description of the Related Art

Hitherto, recording apparatuses such as a printer and a printing machine which perform recording with ink on a recording medium such as a recording sheet have been widely used.

In recent years, the types of recording media have become diversified as the requirements of the market have become more diversified and the recording apparatuses have become more advanced. A variety of recording media, such as a recording sheet whose image quality has been improved by providing an ink receiving layer on the surface thereof, a paperboard such as a postcard having a thickness of at least 0.3 mm, and a piece of cloth which can be recorded on by using a printer, have been commercially used.

Typical recording apparatuses usable for the variety of such recording media are inkjet printers.

In an inkjet printer, the bleeding degree or the coloring state of ink discharged on a recording medium varies depending on the type of the recording medium. Thus, in order to achieve the best image quality, an operator sets the discharge amount and the discharge times of ink from nozzles in accordance with the type of a recording medium by instructing the printer about the type of the recording medium being used from a host computer or from instructing means of the printer.

The increased number of these instructions due to the increased types of recording media causes a complicated operation for an operator, and the printer cannot warn the operator of the wrong instruction when the operator provides a wrong instruction, thereby sometimes resulting in a recorded output having low image quality.

Also, when a network printer is shared by a plurality of operators and is not installed near some of the operators, the operators are required to go to the printer for checking what type of recording media is stored in a recording medium storage (or storage unit) before instructing the type of recording media being used, thereby causing the printer to be used inefficiently.

In a printer in which a necessary type of a recording medium can be selected from among a plurality of types of recording media, for example, by having multi-stage cassettes installed therein, an operator can realize which type of recording media is stored in which cassette only when the operator actually pulls out the cassettes, thereby causing the printer to be used inefficiently.

Some devices for detecting the type of recording media have been provided in order to overcome such disadvantages.

U.S. Pat. No. 6,151,040 has disclosed a recording apparatus and a recording method in which and by which the type of recording media is detected and recording conditions of a recording head are changed in accordance with the detected type of recording media.

Also, Japanese Patent Laid-Open No. 10-198174 has disclosed a sheet-type detector in which the type of sheets is detected by irradiating the uppermost sheet with light emitted from a light-emitting device and by detecting the reflected light by a photo receptor in order to improve its detection accuracy by setting angles of the light-emitting device and the photo receptor in the range from 15° to 30° with respect to the sheet.

In addition, Japanese Patent Laid-Open No. 71-181756 has disclosed an image forming apparatus having a recording-sheet-type detecting function in which a color sensor is disposed for detecting the type of recording sheets in each of multi-stage cassettes and, when the sensor detects the type of recording sheets, the detected information is displayed on a display unit of the apparatus. In this apparatus, when an operator operates a sheet-type selection switch at an operation unit of the apparatus so as to designate the type of recording sheets in advance to be used for making a copy of desired pages of originals consisting of a plurality of sheets, the copy is automatically made using the desired type of sheets.

However, the foregoing known examples have the following disadvantages.

In the recording apparatus disclosed in U.S. Pat. No. 6,151,040, after a starting command for printing is issued, the type of recording media is detected by recording-medium-type detecting means disposed at a point halfway through the transport route of the recording medium toward a recording section of the recording apparatus and the recording medium is subjected to recording under recording conditions in accordance with the type thereof. However, in this recording apparatus, since a printer driver in a host computer starts in reality to create printing data under certain recording conditions as soon as the starting command for printing is issued, and the data is transferred to the recording apparatus, it is difficult to change the recording conditions halfway through the transport of the recording medium.

When the recording apparatus is designed not to create recording data in a period from the issue of a starting command for printing to the completion of detecting the type of recording media, although there is no need to change the recording conditions halfway through the transport of the recording medium, the recording apparatus has a disadvantage of a prolonged recording time in total.

According to the invention set forth in Japanese Patent Laid-Open No. 10-198174, since the light-emitting device and the photo receptor are disposed in each cassette, the recording data can be created after the type of recording media in the cassette is detected in advance. However, this invention has a disadvantage that when distances of the light-emitting device and the photo receptor from the surface of the uppermost sheet change as the amount of remaining sheets varies, the amount of received light of the photo receptor varies, thereby leading to an unreliable determination about an output and resulting in wrong detection.

The invention set forth in Japanese Patent Laid-Open No. 7-181756 also has a disadvantage that since the color sensor for detecting the type of recording sheets is fixed at a specific location in the cassette, a change in a distance of the color sensor from the surface of the uppermost sheet causes wrong detection.

SUMMARY OF THE INVENTION

It is an object of the present invention to provide a recording apparatus which maintains the distance between a medium detection sensor and the uppermost recording medium constant regardless of the remaining amount of recording media in a recording-medium storage so as to reliably detect the type of recording media.

It is another object of the present invention to provide a recording apparatus for recording data on a recording medium, which comprises a recording medium storage for storing a plurality of sheets of recording media; at least one feeding roller for feeding the recording media sheet by sheet from said recording medium storage; a medium detection sensor for detecting the type of the recording media; and a gap maintaining member for maintaining the gap between said medium detection sensor and the recording medium fed by said feeding roller.

Further objects, features and advantages of the present invention will become apparent from the following description of the preferred embodiments with reference to the attached drawings.

DESCRIPTION OF THE PREFERRED EMBODIMENTS

Specific embodiments of the present invention will be described with reference to the accompanying drawings.

First Embodiment

Figure 1:
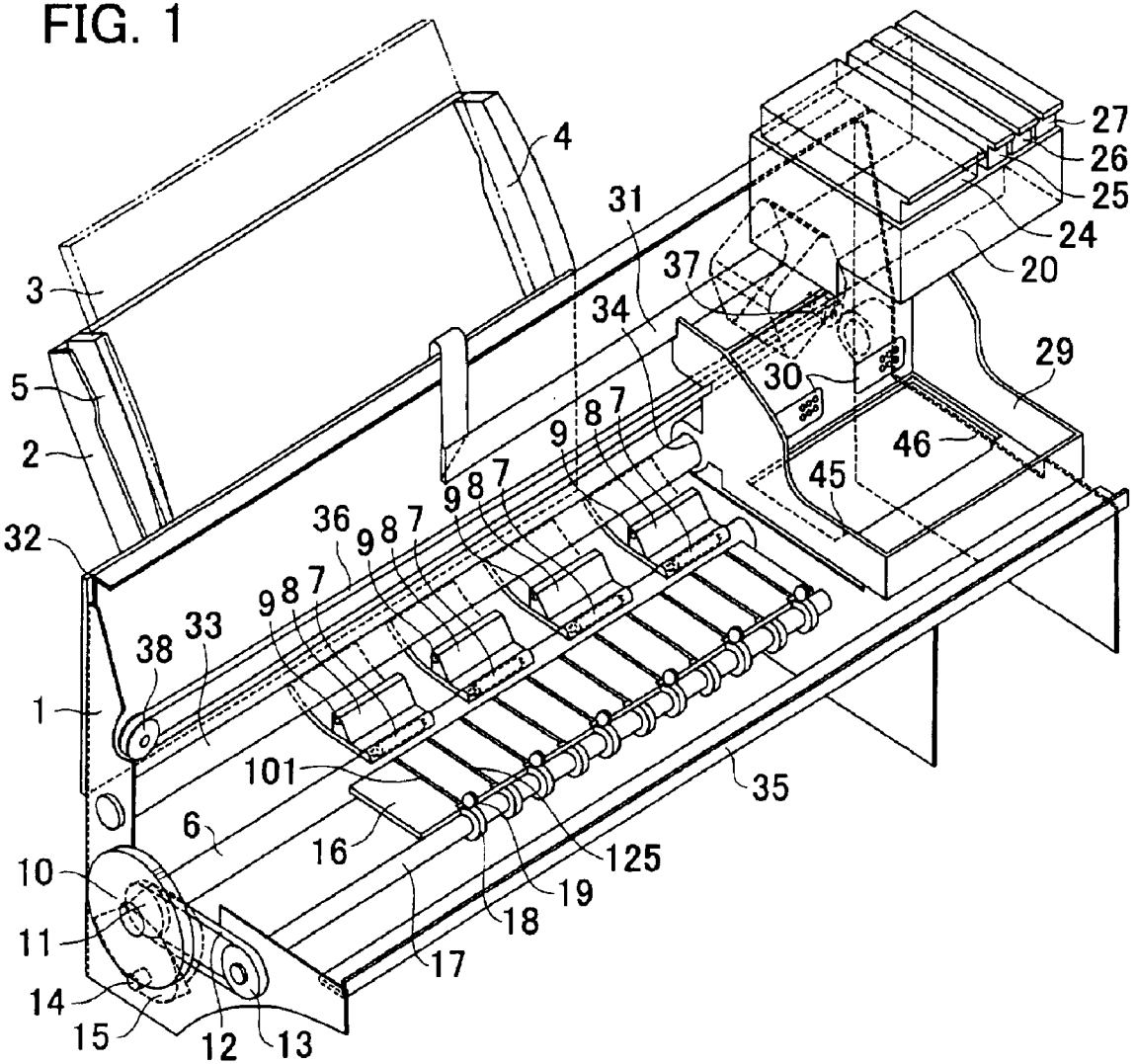
FIG. 1 is a general perspective view of a recording apparatus according to a first embodiment of the present invention.

FIG. 1 is a general perspective view of a recording apparatus according to a first embodiment of the present invention.

As shown in FIG. 1, the recording apparatus has a chassis 1, which has a structure for supporting other components, and an automatic sheet feeder (hereinafter, abbreviated to ASF) base 2, which will be described later.

A sheet fed by the ASF is forwarded to the nips between a line feed (hereinafter, abbreviated to LF) roller 6 and pinch rollers 7. The surface of the LF roller 6 is coated so as to have a predetermined coefficient of friction. Both ends of each pinch roller 7 composed of rubber are rotatably supported by a corresponding pinch roller guide 8 such that the pinch roller 7 rotates freely. The pinch roller guides 8 are rotatable about corresponding rotating shafts 9 and the pinch rollers 7 are urged against the LF roller 6 by corresponding not-shown springs. When the leading edge of the sheet picked up by feeding rollers, which will be described later, reaches the LF roller 6 lying at a standstill, the sheet is forwarded by the feeding rollers by several millimeters further. The sheet is deformed in a rolled shape in this process, and the leading edge of the sheet is aligned by its own stiffness. When the alignment of the leading edge of the sheet is finished, the LF roller 6 starts to rotate so as to forward the sheet to a recording section while the sheet is being sandwiched by the LF roller 6 and the pinch rollers 7.

The LF roller 6 has an LF gear 10 press-fitted into the left end thereof with the chassis 1 interposed therebetween. The LF gear 10 is integrally formed with an LF pulley 11 in a coaxial manner. The LF pulley 11 has an LF belt 12 looped thereover so as to drive a sheet-discharging pulley 13 disposed downstream. The LF gear 10 forms a gear train together with an LF motor gear 14 and is driven by an LF motor 15.

The sheet sandwiched between the LF roller 6 and the pinch rollers 7 is transported over the surface of a platen 16. A sheet-discharging roller 17 is fixed to the sheet-discharging pulley 13 and driven by the LF motor 15. The sheet-discharging roller 17 has 11 rubber components 18 attached thereon, each having not-shown urging means so as to urge a corresponding spur 19. The platen 16 has 11 ribs 101 disposed on the surface thereof.

An inkjet recording head 20 performs recording by discharging ink and has four ink tanks 24 to 27 therein corresponding to black, cyan, magenta, and yellow colors. The ink tank for the black color has a larger capacity than the other ink tanks, taking its frequency of use into account.

The inkjet recording head 20 has 4 nozzle rows for each color, each nozzle row disposed with a pitch of 1/600 inches in the sheet forwarding direction and having 300 nozzles.

The inkjet recording head 20 is inserted, positioned, and fixed in a carriage 29. The carriage 29 has electrode units 30 for respective black and color recording, disposed therein in order to transmit signals from the main body of the recording apparatus to the inkjet recording head 20. When the inkjet recording head 20 is set in the carriage 29, each of the electrode units 30 is pushed to a not-shown head electrode disposed on the inkjet recording head 20 and becomes in a conducting state. Some of these electrodes serve as electrodes for determining whether the head is set or not. That is, it is possible to determine whether the head 20 is mounted or not by measuring a resistance between two of the determining electrodes. The head 20 is positioned by datum planes 45 and 46.

By using a flexible cable 31, the carriage 29 is coupled with a main board 32 fixed on the rear surface of the chassis 1. The flexible cable 31 has the foregoing electrode units 30 disposed at one terminal thereof.

A carriage shaft 33 extends through a bearing 34 of the carriage 29. Both ends of the carriage shaft 33 are supported by the chassis 1. A not-shown slider disposed downstream from the carriage 29 slides on a carriage rail 35, and both ends of the carriage rail 35 are also supported by the chassis 1.

The carriage 29 having the inkjet recording head 20 mounted thereon is guided by the carriage shaft 33 and the carriage rail 35 so as to move in a direction perpendicular to the sheet forwarding direction. The carriage 29 has a carriage belt 36 bonded thereto, which is looped over a pulley of a carriage motor 37 and an idler pulley 38. The carriage 29 moves in a reciprocating manner while being driven by the carriage motor 37 via the carriage belt 36. While the carriage 29 is moving, the orifice surfaces of the nozzles of the inkjet recording head 20 and the sheet surface are maintained so as to have a gap of 1.5 mm therebetween.

Figure 2:
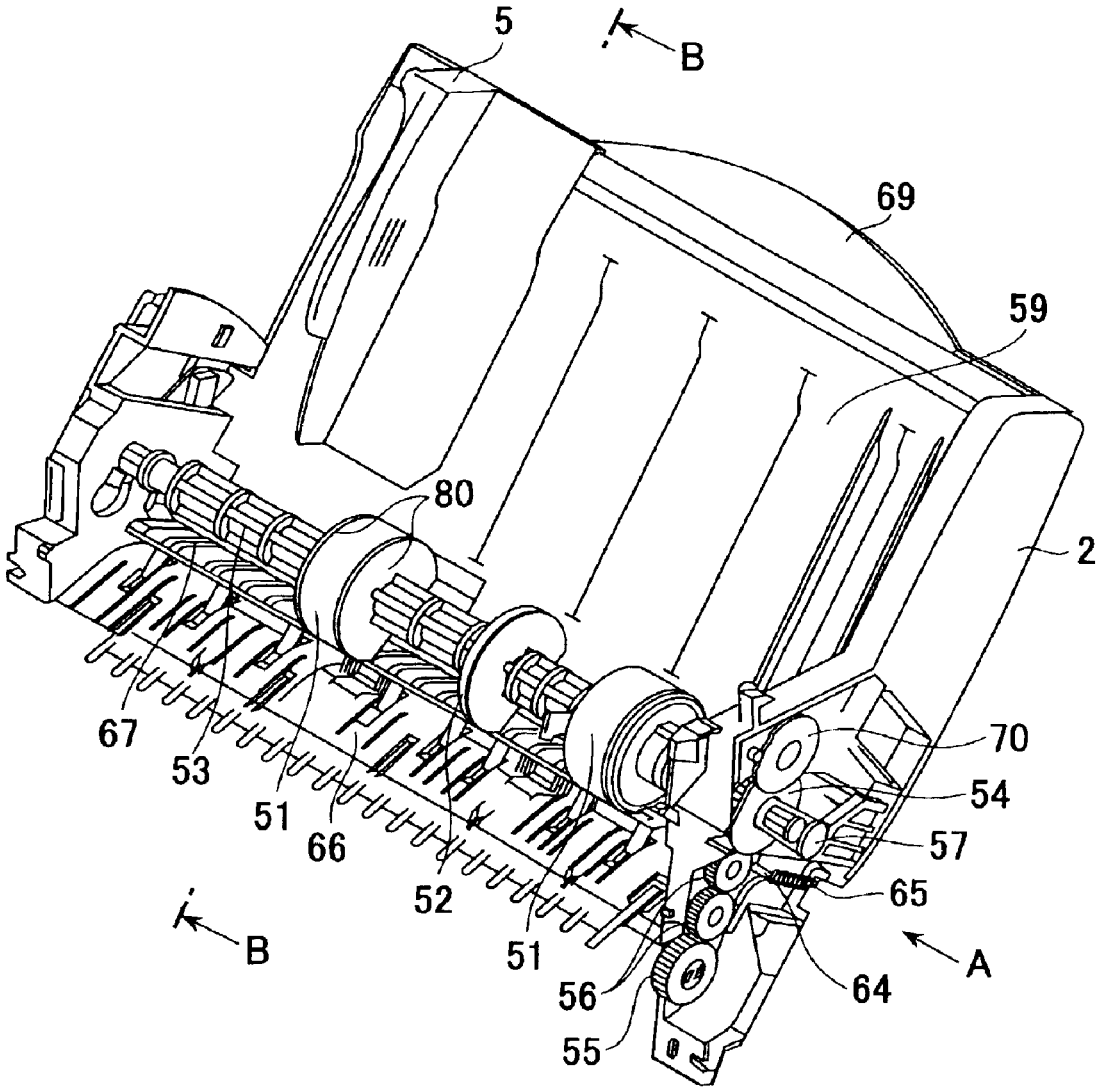
FIG. 2 is a perspective view of an automatic sheet feeder (ASF) of the recording apparatus according to the first embodiment.
Figure 3:
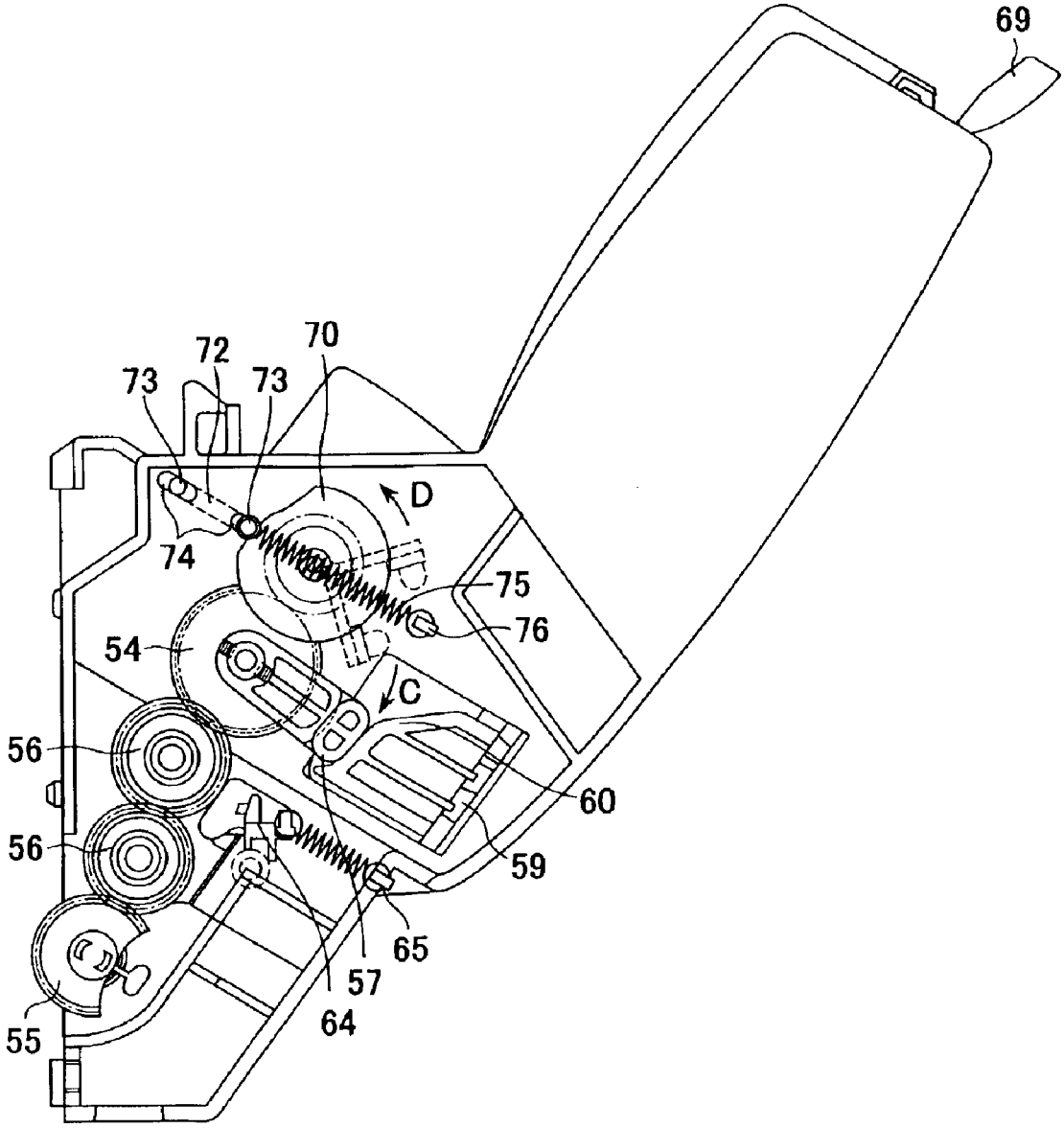
FIG. 3 is a side view of the ASF viewed from the arrow A indicated in FIG. 2.
Figure 4:
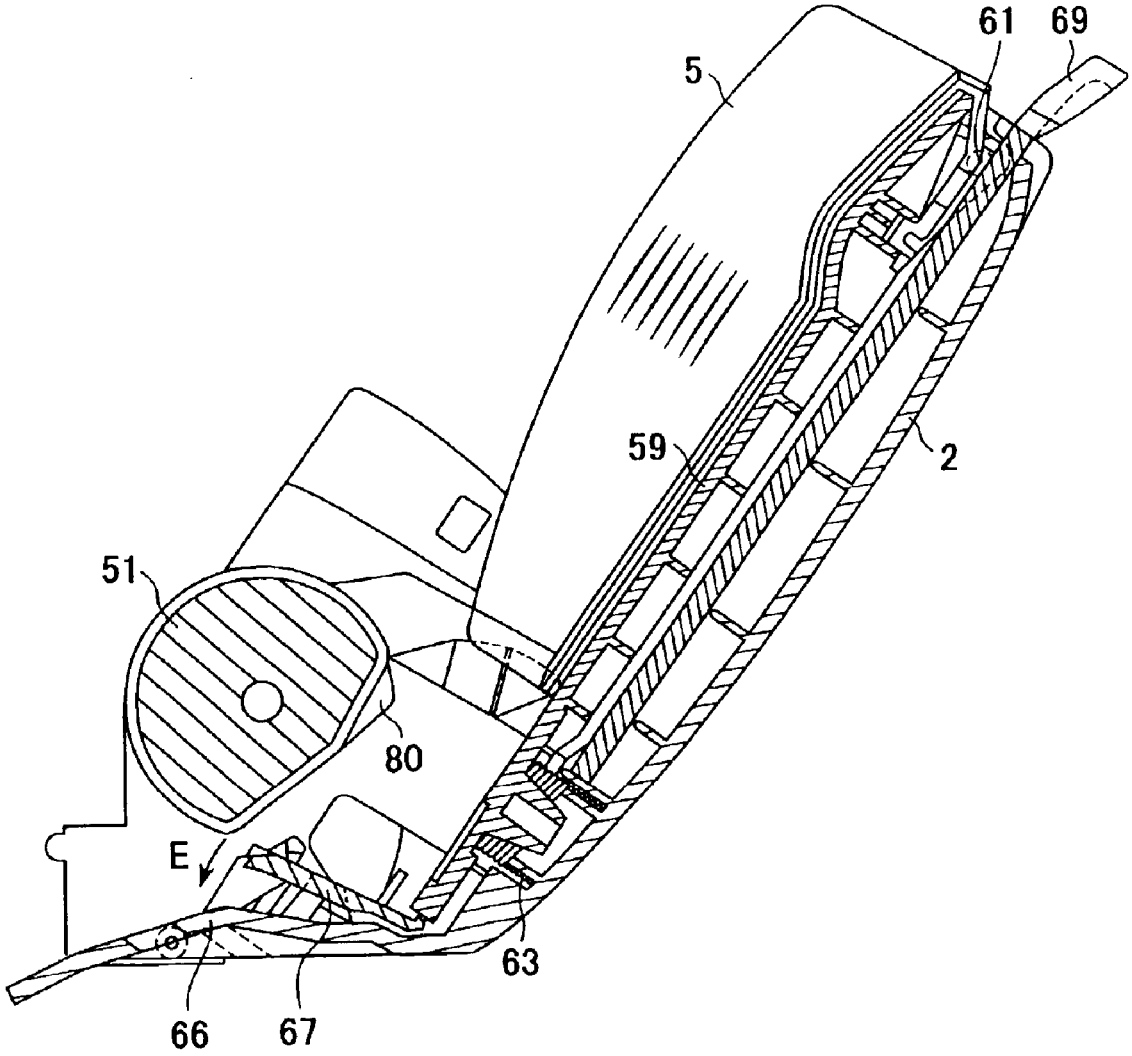
FIG. 4 is a sectional view of the ASF taken along the line B—B indicated in FIG. 2.

FIG. 2 is a perspective view of the ASF having a recording-medium-type detector which is the main feature of the present invention, FIG. 3 is a side view of the ASF viewed from the arrow A indicated in FIG. 2, and FIG. 4 is a sectional view of the ASF taken along the line B—B indicated in FIG. 2.

As shown in FIG. 2, the ASF base 2 and two right and left feeding rollers 51 are provided. A sheet having a size of A4 or the like is fed using these two feeding rollers 51. When a sheet having a small size such as a postcard is fed, the right feeding roller 51 and an auxiliary feeding roller 52 are used. The surfaces of these rollers are composed of rubber so as to provide a large frictional force against a sheet. The feeding rollers 51 and the auxiliary feeding roller 52 are fixed to a feeding roller shaft 53. Each of the auxiliary feeding roller 52 and the feeding roller shaft 53 has collars 80, integrally formed with the feeding roller shaft 53, at both ends of its rubber part. As shown in FIG. 4, when a pressure plate 59, which will be described later, ascends towards the feeding rollers 51, the uppermost sheet loaded on the pressure plate 59 first comes into contact with the collars 80. Subsequently, the feeding roller shaft 53 rotates by a predetermined amount, and then the sheet loaded on the pressure plate 59 comes into contact with the rubber parts of the feeding rollers 51 and starts to be forwarded. With this arrangement, the sheet loaded on the pressure plate 59 is prevented from being forwarded in a state in which a contact pressure between the sheet and the feeding rollers 51 is unstable due to vibrations occurring right after the ascending of the pressure plate 59, thereby preventing a problem that the sheet is forwarded at a slanted angle. Both ends of the feeding roller shaft 53 are rotatably supported by the ASF base 2 so that the feeding roller shaft 53 is rotatable together with the feeding rollers 51. The feeding roller shaft 53 has a feeding cam gear 54 fixed at the right end thereof. The feeding cam gear 54 engages with an input gear 55 having two idler gears 56 interposed therebetween. The input gear 55 is driven by a not-shown drive source. Upon moving in the direction indicated by the arrow C shown in FIG. 3, a cam 57 of the feeding cam gear 54 abuts against a cam follower 60 integrally formed with the pressure plate 59, thereby causing the pressure plate 59 to be pressed into contact with or detached from the feeding rollers 51. The pressure plate 59 can turn about right and left pressure-plate shafts 61 as shown in FIG. 4. The ASF base 2 and the pressure plate 59 have pressure-plate springs 63 inserted between the rear surfaces thereof so as to urge the pressure plate 59 against the feeding rollers 51. In a state shown in FIG. 4, since the pressure plate 59 is kept away from the feeding rollers 51, the pressure-plate springs 63 are fully compressed. When sheets 3 are loaded on the pressure plate 59 as shown in FIG. 1, the uppermost sheet is urged against the feeding rollers 51 and is brought forward as the feeding rollers 51 rotates.

In a state shown in FIG. 3, a separation claw 64 is stretched by a claw spring 65. When the leading edges of the sheets 3 reach the separation claw 64, and if the sheets 3 are thin, the sheets 3 are deformed into a rolled shape by the separation claw 64, and only the uppermost sheet 3 is separated from the remaining sheets 3 by the so-called claw separation of the separation claw 64 and is fed. If the sheets 3 are so thick that they are not deformed into a rolled shape, the sheets 3 having large stiffness cause the separation claw 64 to fall down against an urging force of the claw spring 65, and only the uppermost sheet 3 is separated from the remaining sheets 3 by the bank separation of a bank 66 shown in FIG. 4 and is fed. A movable bank 67 is disposed upstream from the bank 66 and has an upward angle so as to prevent the loaded sheets 3 from falling down. When the sheet 3 is fed, in conjunction with the rotation of the feeding rollers 51, not-shown cam means causes the movable bank 67 to move in the direction indicated by the arrow E shown in FIG. 4 such that the sheet 3 is easily fed. Upon completion of feeding the sheet 3, the movable bank 67 returns to its original position.

A side guide 5 is slidable in accordance with the width of sheets, and an auxiliary feeding tray 69 is retractable in accordance with the length of the sheets.

A medium-detection-sensor control cam 70 shown in FIGS. 2 and 3 engages with the feeding cam gear 54 and rotates in the direction indicated by the arrow D shown in FIG. 3 in synchronization with the feeding cam gear 54. A sensor support 72 has two pins 73 integrally formed therewith. The pins 73 are inserted into corresponding slots 74 formed on the side surface of the ASF base 2. The sensor support 72 is supported by the ASF base 2 by using a not-shown latch so as to be slidable along the longitudinal direction of the slots 74. The cam surface of the medium-detection-sensor control cam 70 lies in contact with the right pin 73. Also, the right pin 73 is pushed to the cam surface of the medium-detection-sensor control cam 70 by a sensor spring 75 disposed between the right pin 73 and a spring retainer 76 disposed on the ASF base 2. With this structure, the sensor support 72 moves linearly as the medium-detection-sensor control cam 70 rotates.

Figure 5:
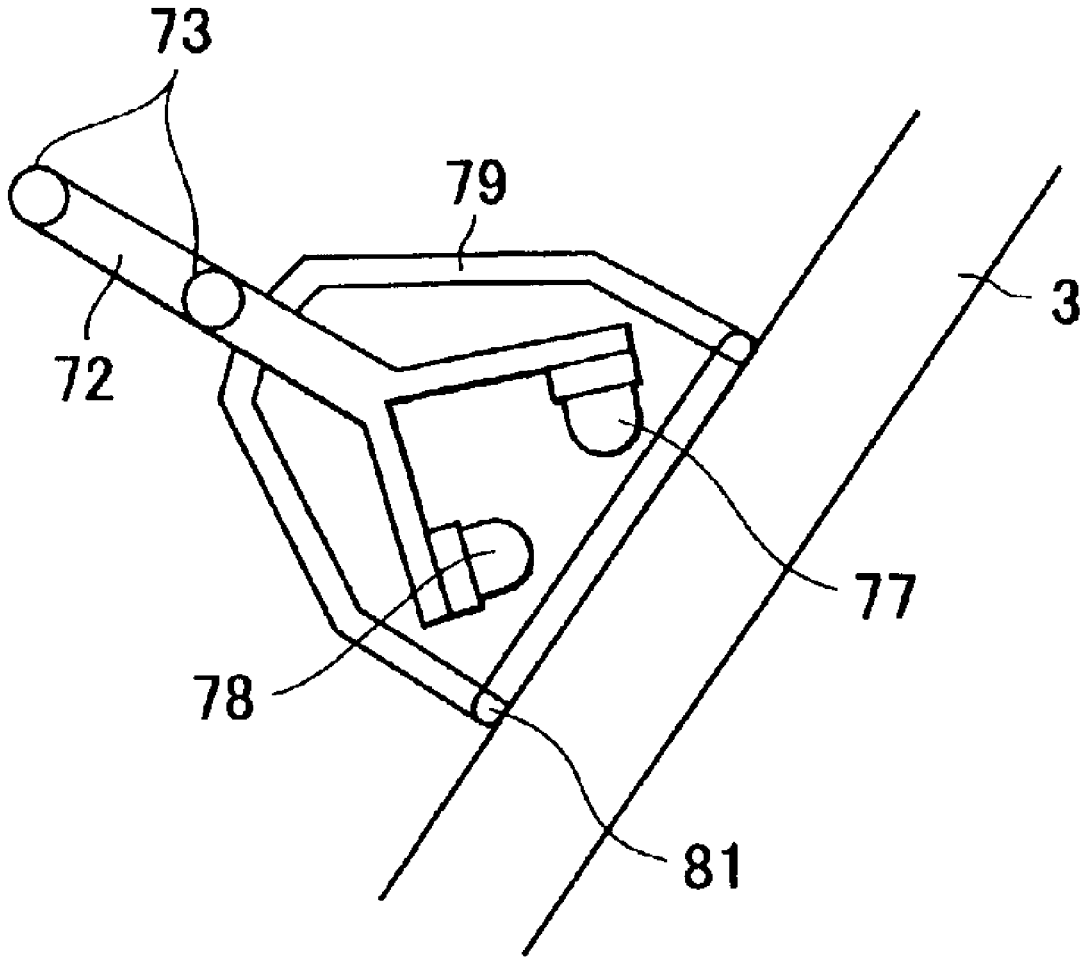
FIG. 5 illustrates a sensor and the vicinity thereof of the recording apparatus according to the first embodiment.

Referring now to FIG. 5, a medium detection sensor will be described. The medium detection sensor is disposed at the top of the sensor support 72. As shown in FIG. 5, a light emitting device 77 for emitting light at 45 degrees with respect to the sheet surface and a photo receptor 78 for detecting part of the light reflected at the sheet surface are fixed to the sensor support 72. Since the amount of reflected light depends on the surface property of a sheet, the type of the sheet can be specified on the basis of the amount of reflected light. A hood 79 is disposed in order to maintain the distance between the light emitting device 77 and the photo receptor 78 and the surface of the sheet 3 constant and also to cut off outside light. The hood 79 has an approximately conical shape so as to surround the top of the sensor support 72 and moves together with the sensor support 72. The hood 79 has a hood rubber 81 disposed along the periphery of the opening thereof such that the hood 79 and the sheet 3 lie in close contact with each other even when the hood 79 and the sheet surface have a slight angle with each other. Since the opening of the hood 79 abuts against the sheet surface while being pushed by a load of the foregoing sensor spring 75, the distance between the light emitting device 77 and the photo receptor 78 and the surface of the sheet 3 is always maintained constant while the type of recording sheets is being detected.

Figure 6A:
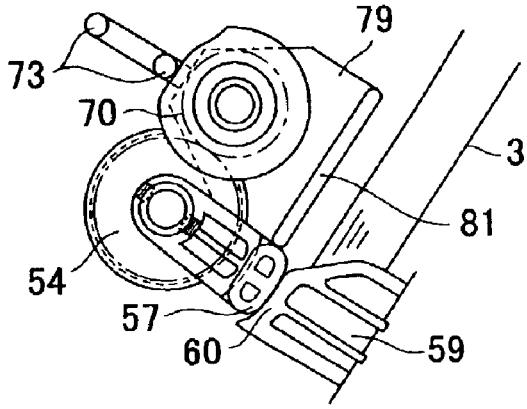
FIGS. 6A to 6D illustrate a cam operational diagram of the recording apparatus according to the first embodiment.
Figure 6B:
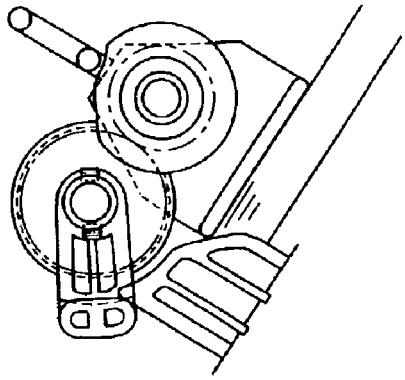
Figure 6C:
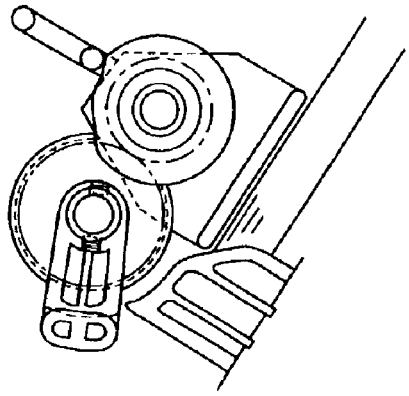
Figure 6D:
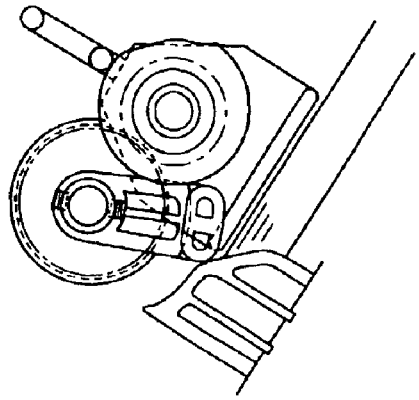
Figure 7:
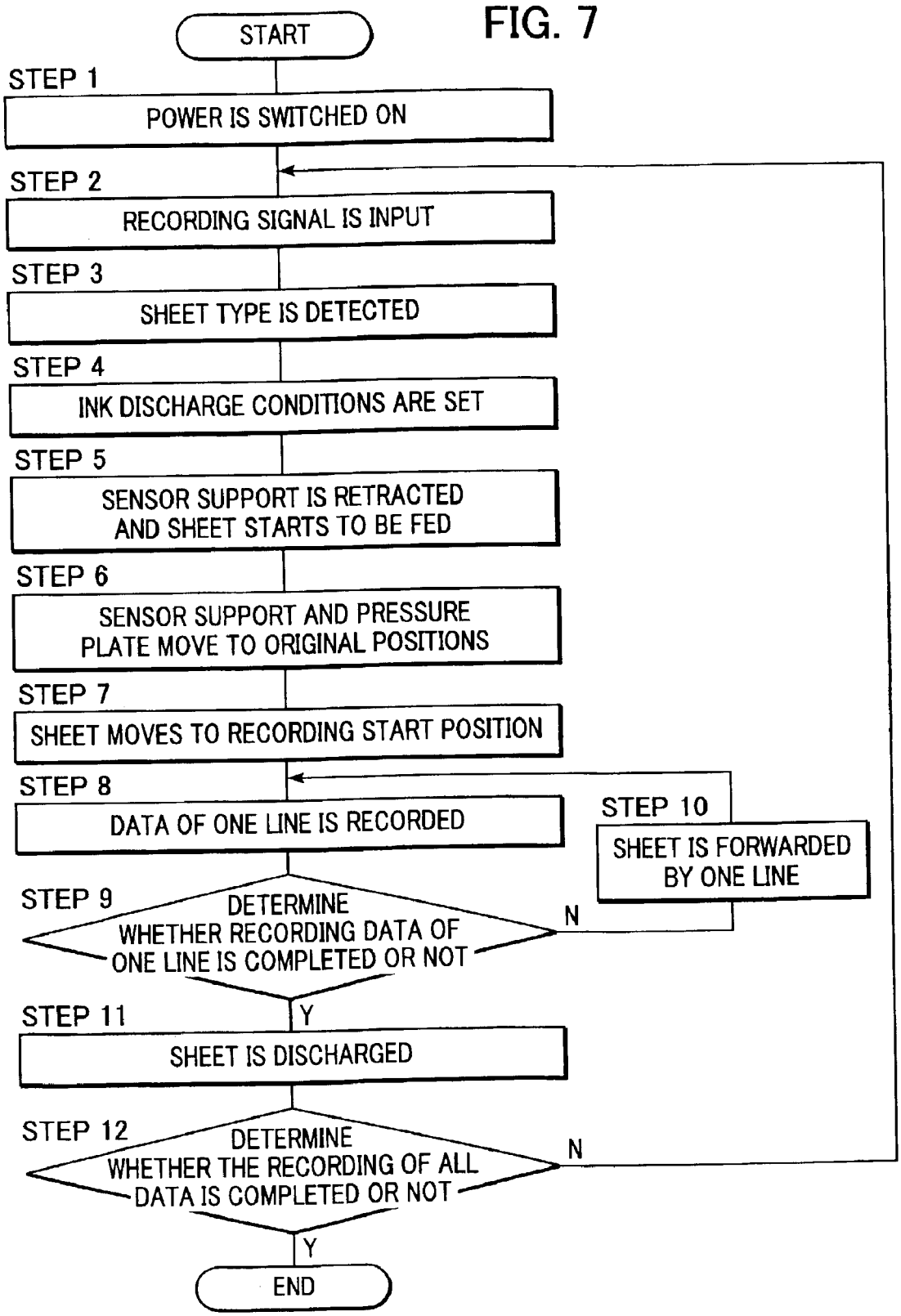
FIG. 7 is a flowchart illustrating an operation of the recording apparatus according to the first embodiment.

A recording operation will be described with reference to FIGS. 6A to 6D illustrating an operational diagram of the cams and FIG. 7 illustrating a flowchart of an operation of the recording apparatus. For simplification, only a part of the recording apparatus lying in the vicinity of the cams is illustrated in FIGS. 6A to 6D and the other part which is unnecessary for this description is omitted.

In a state shown in FIG. 6A, when the power is to be turned on (STEP 1), the pressure plate 59 is detached from the feeding roller 51 by the cam 57 and the sheet 3 is kept away from the opening of the hood 79. Also, the pins 73 are at rest while abutting against the cam surface of the medium-detection-sensor control cam 70. Accordingly, sheets can be easily loaded in this state.

Then, in a state shown in FIG. 6B, when a recording signal is input (STEP 2), the feeding cam gear 54 and the medium-detection-sensor control cam 70 rotate by 45 degrees. Since the cam 57 moves and the pressure plate 59 moves upwards, the foregoing collars 80 come to rest upon coming into contact with the sheets loaded on the pressure plate 59. At the same time, the sensor support 72 is pushed up by the surface of the uppermost sheet 3 and the right pin 73 is detached from the cam surface of the medium-detection-sensor control cam 70 by a distance of 1 mm. In this state, the type of recording media is detected (STEP 3). On the basis of the detected information, a driver attached to a host computer sets the optimal discharge amount and the discharge times of ink from the nozzles in accordance with the type of recording media (STEP 4).

In a state shown in FIG. 6C, when the feeding cam gear 54 and the medium-detection-sensor control cam 70 rotate 10 degrees further, the feeding roller 51 comes into contact with the pressure plate 59 so as to start feeding the sheet 3. Shortly before feeding the sheet 3, the cam surface of the medium-detection-sensor control cam 70 comes into contact with the right pin 73, the sensor support 72 moves, and the hood rubber 81 is detached from the sheet 3 (STEP 5). As a result, the sheet 3 to be fed and the hood rubber 81 do not come into contact with each other.

In a state shown in FIG. 6D, when the cam 57 and the cam follower 60 start to come into contact with each other and the pressure plate 59 starts to be detached from the feeding roller 51, the sensor support 72 moves downwards along the cam surface of the medium-detection-sensor control cam 70 and the cam operation returns to the state shown in FIG. 6A (STEP 6).

The position of the sheet, fed as mentioned above, is detected in the transport direction thereof by a not-shown sensor and the sheet comes to rest at a predetermined recording start position (STEP 7).

Then, the carriage 29 scans the sheet 3 and performs recording of the data of one line (STEP 8). When data to be recorded still remains (STEP 9), the sheet 3 is forwarded by a space of 300 nozzles, and the carriage 29 performs recording of the data of the following line (STEP 10). Subsequently, the scanning of the carriage 29 and the forwarding of the sheet 3 are repeatedly performed until no data to be recorded remains, and when this recording operation is completed, the sheet 3 is discharged into a not-shown discharge tray (STEP 11). When the second page is to be recorded (STEP 12), the recording operation is returned to STEP 2 and the same operation is repeated; otherwise, the recording apparatus is put in a standby mode.

Means for maintaining the gap between the medium detection sensor and the sheet surface constant while the type of recording media is being detected is not limited to that according to this embodiment; all means including the one in which an additional drive source moves the medium detection sensor in accordance with a phase of the pressure plate are applicable as long as they maintain the above-mentioned gap constant. In this embodiment, when the sheets 3 are to be loaded, the sheets 3 become free from being urged by detaching the pressure plate from the sheets 3, and, when the sheet 3 is to be fed, the sheet 3 becomes free from being urged by detaching the sensor support 72 from the sheet 3. However the present invention is not limited to the above-mentioned structure; it may have a structure in which all urges are released by the sensor support 72. In this case, the medium detection sensor may be disposed on the pressure plate.

The medium detection sensor is not limited to a combination of a light-emitting device and a photo receptor; a variety of other means including the one in which an image scanning device such as a CCD is used so as to specify the type of recording sheets by scanning an image pattern of the sheet surface are applicable to the present invention.

Second Embodiment

Figure 8:
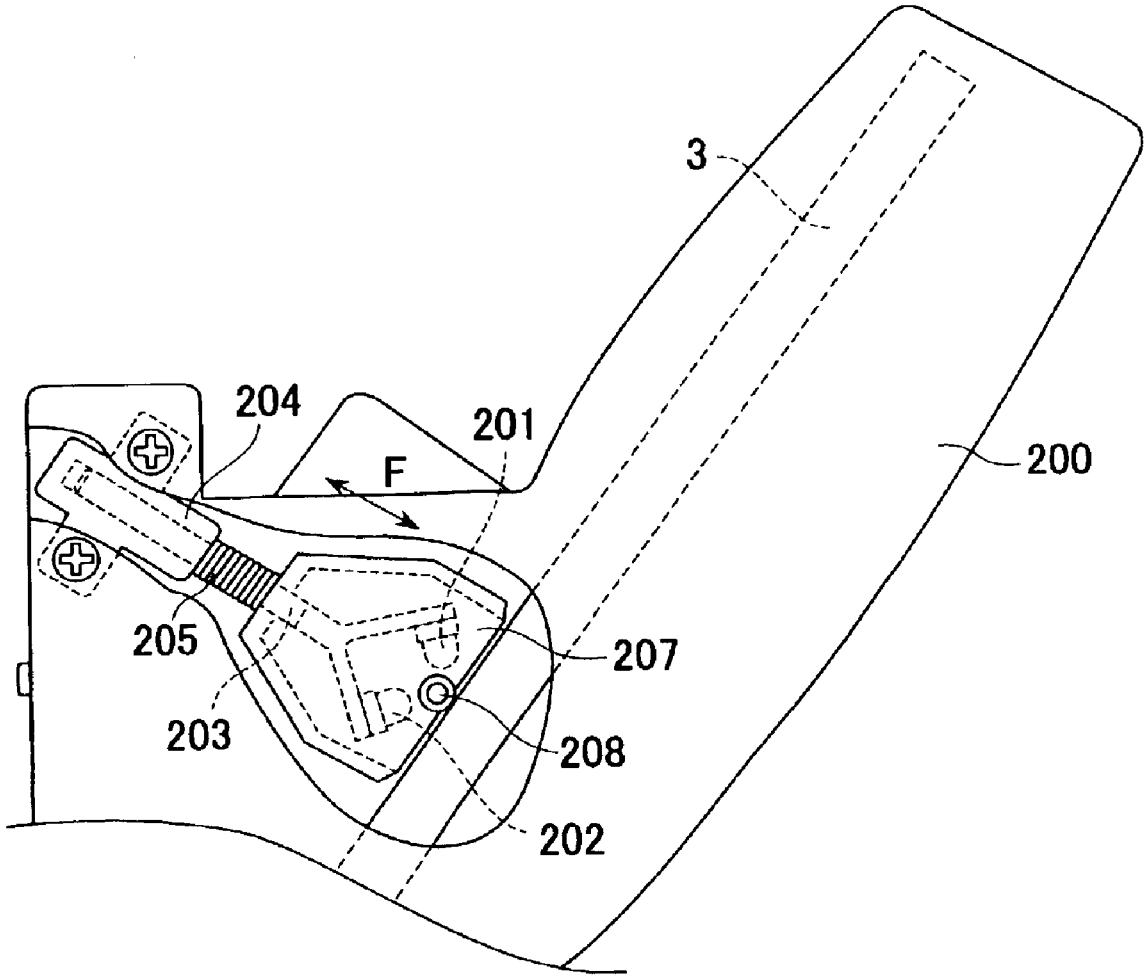
FIG. 8 is a side view of an ASF of a recording apparatus according to a second embodiment of the present invention.

FIG. 8 is a side view of a recording apparatus according to a second embodiment of the present invention, wherein like components as in the first embodiment are omitted.

An ASF base 200 shown in FIG. 8 has the same function as that in the first embodiment. A light-emitting device 201 and a photo receptor 202 detect the type of recording media based on the same principle as that in the first embodiment. The light-emitting device 201 and the photo receptor 202 are supported by a sensor-support slider 203. A shaft of the sensor-support slider 203 is guided by a hole formed in a slider casing 204 so as to move in the direction indicated by the arrow F shown in FIG. 8. The slider casing 204 is fixed to the side surface of the ASF base 200 with screws. The shaft of the sensor-support slider 203 is also inserted into a compression spring 205. The light-emitting device 201 and the photo receptor 202 are surrounded by a hood 207 having rollers 208 disposed at two places on the side surfaces of the hood 207.

In this embodiment, the sensor-support slider 203 is always urged towards the surface of the uppermost sheet 3 by the compression spring 205. When the type of recording sheets is detected, the rollers 208 come into contact with the surface of the uppermost sheet. When the sheet is fed, since the rollers 208 rotate as the sheet moves, the rollers 208 do not cause a resistance for transporting the sheet.

According to this embodiment, the cam mechanism for moving the sensor support 72 is not needed, thereby achieving a simple structure of the recording apparatus.

Third Embodiment

Figure 9A:
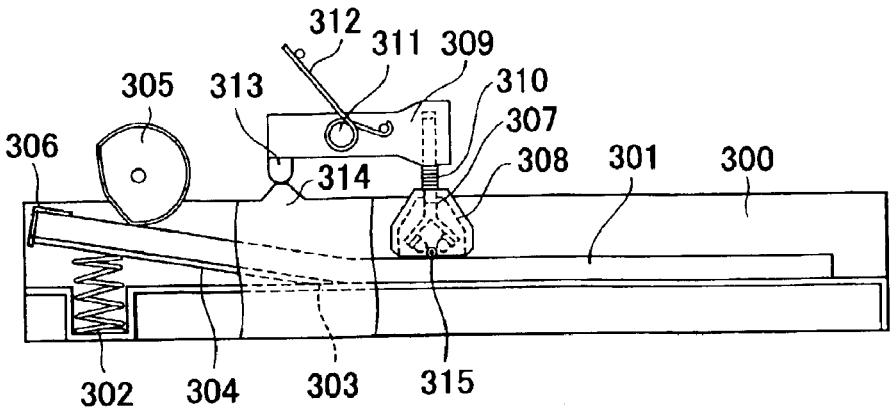
FIGS. 9A and 9B are side views of a cassette of a recording apparatus according to a third embodiment of the present invention.
Figure 9B:
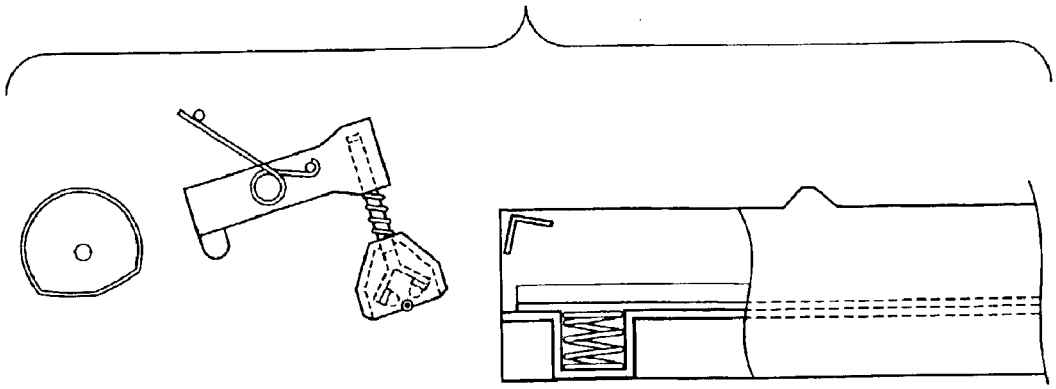

FIGS. 9A and 9B are side views of a cassette of a recording apparatus according to a third embodiment of the present invention, wherein FIG. 9A illustrates a state in which the cassette is loaded and FIG. 9B illustrates a state in which the cassette is unloaded. Recording media 301 are stored in a cassette 300 having therein a pressure-plate spring 302 and a pressure plate 304, which is urged upwards about a fulcrum 303 as a rotating axis. As shown in FIG. 9A, when the recording media 301 are fed, the surface of the uppermost recording medium 301 comes into contact with the surface of a feeding roller 305 by a not-shown cam. When the feeding roller 305 rotates clockwise in FIG. 9A, the recording media 301 are forwarded and only the uppermost one is separated and picked up by a separation claw 306. A light-emitting device and a photo receptor are disposed at the top of a sensor support 307 in the same fashion as in the first embodiment. Since a hood 308 has the same function as that in the first embodiment, its description is omitted. A shaft of the sensor support 307 is inserted into and guided by a hole of a sensor lever 309 so as to be vertically slidable. A compression spring 310 has the same function and structure as those in the second embodiment. The sensor lever 309 has a rotating shaft 311 protruding therefrom and a torsion coil spring 312 which is hooked on the rotating shaft 311 so as to urge the sensor lever 309 counterclockwise. In addition, the sensor lever 309 has a projection 313. In a state in which the cassette 300 is loaded, the projection 313 abuts against an abutment 314 disposed on the exterior frame of the cassette 300 and keeps the cassette 300 horizontal against a load of the torsion coil spring 312. In this state, rollers 315 rotatably supported by the hood 308 in the same fashion as in the second embodiment lie in contact with the uppermost recording medium 301 and compress the compression spring 310 so as to exert a contact load on the recording media 301.

When the cassette 300 is unloaded as shown in FIG. 9B, since the projection 313 is detached from the abutment 314, the sensor lever 309 rotates counterclockwise with the load of the torsion coil spring 312 and abuts against a not-shown stopper to a halt.

The cassette 300 can be loaded again without a chance of the rollers 315 and the hood 308 coming into contact with the surface of the uppermost recording medium 301, thereby allowing the cassette 300 to be easily loaded and preventing a surface flaw of the recording medium 301. At the last moment of inserting the cassette 300, the rollers 315 come into contact with the surface of the uppermost recording medium 301 and the type of the recording media 301 stored in the cassette 300 is ready to be detected at any given timing.

That is, the detection may be performed whenever the cassette 300 is loaded or only when instructed by instructing means disposed independently.

As described above, according to this embodiment, since there are provided a recording medium storage for storing a plurality of sheets of recording media, feeding rollers for feeding the recording media sheet by sheet from the recording medium storage, a medium detection sensor, and a gap maintaining member for maintaining the gap between the medium detection sensor and the recording medium fed by the feeding rollers, the gap between the medium detection sensor and the recording medium fed by the feeding rollers can be maintained constant regardless of the remaining amount of the recording media stored in the recording medium storage, thereby achieving a recording apparatus which can reliably detect the type of recording media.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus for recording data on a recording medium, comprising:

a recording medium storage unit for storing a plurality of sheets of recording media;

at least one feeding roller for feeding the recording media sheet by sheet from said recording medium storage unit;

a medium detection sensor for detecting the type of the recording media; and a gap maintaining member for maintaining the gap between said medium detection sensor and the recording medium stored in said recording medium storage unit, wherein said gap maintaining member comprises a support member for supporting said medium detection sensor and urging means for urging the support member against the recording media.

2. The recording apparatus according to claim 1, wherein the support member has a shape, in which only a contact surface with the recording medium is open towards an exterior space, and which forms a closed space together with the recording medium by coming into contact with the recording medium so as to separate said medium detection sensor from the exterior space.

3. The recording apparatus according to claim 2, further comprising an elastic member disposed on the contact portion of the support member contacting with the recording medium.

4. The recording apparatus according to claim 1, wherein the support member urged by the urging means becomes free from being urged before the recording medium is fed by said at least one feeding roller.

5. The recording apparatus according to claim 1, wherein the support member is free from being urged when the recording apparatus is in a standby mode and the support member is urged by the urging means after the recording apparatus starts a recording operation.

6. The recording apparatus according to claim 5, wherein, when the recording medium is fed by said at least one feeding roller, the support member becomes again free from being urged.

7. The recording apparatus according to claim 1, further comprising at least one roller which is rotatably supported by the support member and which rotates in conjunction with movement of the recording medium fed by said at least one feeding roller.

8. The recording apparatus according to claim 1, wherein said recording medium storage unit is a detachable cassette, and wherein the support member urged by the urging means becomes free from being urged when the cassette is unloaded, and the support member is urged by the urging means when the cassette is loaded.

9. The recording apparatus according to claim 1, further comprising instructing means for instructing said medium detection sensor regarding an operation of detecting the type of the recording media.

10. The recording apparatus according to claim 1, wherein said medium detection sensor comprises a light-emitting device and a photo receptor, and wherein the recording medium fed by said feeding roller is irradiated with light emitted from the light-emitting device and part of the light reflected at the recording medium is detected by the receptor.

11. The recording apparatus according to claim 1, wherein said medium detection sensor comprises an image scanning device.

* * * * *

UNITED STATES PATENT AND TRADEMARK OFFICE

CERTIFICATE OF CORRECTION

PATENT NO. : 7,083,245 B2
APPLICATION NO. : 10/406456
DATED : August 1, 2006
INVENTOR(S) : Yamamoto It is certified that error appears in the above-identified patent and that said Letters Patent is hereby corrected as shown below:

COLUMN 2

Line 5, "71-181756" should read --7-181756--.

Signed and Sealed this

Second Day of December, 2008

JON W. DUDAS
*Director of the United States Patent and Trademark Office*